United States Patent [19]

Arthur

[11] Patent Number: 4,471,160

[45] Date of Patent: Sep. 11, 1984

[54] WRAPPED AND SOLDERED WIRE TERMINATION INCLUDING SLOTTED SPHERICAL TERMINAL AND METHOD OF PRODUCING SAME

[76] Inventor: James L. Arthur, 301 Morris Ave., Lutherville, Md. 21093

[21] Appl. No.: 369,576

[22] Filed: Apr. 19, 1982

[51] Int. Cl.[3] ..... H01R 4/02; H01B 17/14

[52] U.S. Cl. ..... 174/94 R; 29/860; 174/127; 174/166 S; 339/275 R

[58] Field of Search ..... 174/127, 145, 166 S, 174/94 R, 152 S, 94, 166; 339/143 C, 275 R, 276 A, 276 S, 32 R, 198 R, 198 C, 198 E, 255 B, 256 C, 257, 258 C, 263 S, 275 B, 275 T, 277 R, 278 R, 278 T, 275, 276; 228/215; 29/860; 338/322, 329, 332; 313/135; 403/206, 209, 272

[56] References Cited

U.S. PATENT DOCUMENTS

| | | | |
|---|---|---|---|
| 1,024,601 | 4/1912 | Schaefer, Jr. | 339/278 R X |
| 1,255,880 | 2/1918 | Hill | 339/32 R X |
| 1,568,621 | 1/1926 | Rabezzana | 174/152 S X |
| 1,765,868 | 6/1930 | Lafite | 339/278 R |
| 1,821,443 | 9/1931 | Mohr | 339/257 |
| 1,900,206 | 3/1933 | Silberstein | 338/322 X |
| 2,386,171 | 10/1945 | Wild | 339/275 R X |
| 2,440,828 | 5/1948 | Nichols | 174/127 X |
| 2,899,486 | 8/1959 | Abrams | 174/166 S |

*Primary Examiner*—Laramie E. Askin

*Attorney, Agent, or Firm*—Thomas E. Spath

[57] ABSTRACT

An improved electrical terminal designed to eliminate arcing and corona effects has a substantially spherical post with one or more circumferential slots perpendicular to the longitudinal axis of the terminal. In one embodiment, each slot is adapted to receive a wire of predetermined gage in a close-fitting wrapped configuration. The outer diameter of the wire does not extend beyond the circumference of the sphere. The number and size of the slots depends on the number and gage of the wire(s) to be connected. More than one wire can be connected in a single slot, either by wrapping the wires concentrically or in parallel planes within the same slot. Solder is applied to the wrapped wires to form a secure, smooth and rounded connection.

7 Claims, 9 Drawing Figures

WRAPPED AND SOLDERED WIRE TERMINATION INCLUDING SLOTTED SPHERICAL TERMINAL AND METHOD OF PRODUCING SAME

BACKGROUND OF THE INVENTION

1. Field of the Invention

This invention relates to insulated, stud-mounted terminals for facilitating electrical interconnections and terminations and more generally to a terminal for connecting one or more wires that is designed to substantially eliminate electrical arcing and corona discharge. Such terminals are intended for use in applications where 'high voltages', i.e., greater than 50 VDC or VAC, are present in close proximity to the terminals.

As used herein, the word "terminal" means a device of electrically conductive material, such as copper, brass or aluminum, about which are wrapped one or more wires that are soldered in place to afford a secure and reliable electrical connection. There are numerous terminal designs in common use. One such model, which serves as a convenient reference in describing one embodiment of the invention, is the insulated, stud-mounted 2. Description of the Prior Art Insulated, stud-mounted terminals consist of a base unit, an intermediate insulating medium and a terminal stud, all axially aligned and forming a rigid integral structure. In one typical construction, for example Military Specification MIL T-55155/9A, the base unit comprises a threaded base projecting from a hexagonal shank to which are assembled a lock washer and nut to secure the terminal to a circuit board, chassis, or the like. The hexagonal shank portion is permanently affixed to the lower section of the insulating medium, as by direct molding or by an adhesive. Projecting from, and affixed to, the opposite surface of the insulating medium is the conducting terminal stud which is in axial alignment with the threaded base. The terminal stud consists of a cylindrical post section and typically has a flattened top, or cap, and a projecting shoulder adjacent the insulating medium, both of a diameter slightly larger than the post. The purpose of the cap and shoulder is to keep the wire or wires from slipping off the top of the post or contacting the insulating medium. After one or more wires are wrapped around the terminal post, solder is applied to secure them and to assure good electrical connection. In order to reduce the likelihood of arcing and eliminate corona effects, the solder mass must be formed into as nearly a spherical mass as possible. This hand-soldering operation is time-consuming and therefore expensive, requires a relatively high skill level and must be carefully inspected to meet quality control standards.

It is therefore a purpose of the invention to provide a conducting terminal to which soldered single wire termination or multiple wire interconnections can be rapidly accomplished.

Another purpose of the invention is to provide a wiring terminal in which a secure and substantially spherical soldered connection can be quickly and reliably completed.

A further purpose of the invention is to provide an insulated, stud-mounted terminal having improved resistance to electrical arcing and corona effects.

SUMMARY OF THE INVENTION

The above objectives and other advantages are attained by the invention which comprises a substantially spherical terminal post having one or more circumferential slots generally perpendicular to the axis of the stud where each of said slots is adapted to accommodate a wrapped wire termination in close-fitting relation and the outer surface of said wire does not extend above the projection of the adjacent spherical surfaces. In the preferred embodiment each slot is adapted to receive a single wrapped wire termination.

The invention can be constructed to make single wire terminations or multiple wire interconnections. After each wire has been fitted to a slot and wrapped snugly about the terminal post, solder is applied to the assembly to secure the wire in position and to assure a good electrical connection.

As will be apparent to one familiar with the art, the soldering step can be accomplished quickly and will result in a substantially spherical termination as the molten solder will readily seek out and fill the interstices between the slot in the terminal post and the close-fitting wire positioned within the slot. The spherical, wire-wrapped slotted terminals of my invention are also adapted to dipping into a bath of molten solder to complete the assembly and will result in a smooth, substantially spherical product, free of sharp edges and protrusions, and having a greatly reduced tendency towards electrical arcing or corona effects.

Since each slot is adapted to receive the specific gage of wire used in making the termination and the wrapped wire does not extend or protrude above the projection of the adjacent spherical surfaces of the terminal post, hand wrapping of the wire is expedited. Most importantly the tedious and often imperfectly performed task of producing by hand a spherical soldered connection between one or more wires is eliminated.

In alternative embodiments, the terminal comprises a spherical terminal post which is provided with one or more circumferential slots, generally perpendicular to the terminal axis, where one or more of the slots is adapted to receive a plurality of wire terminations, either in a concentrically wrapped configuration, or in a parallel side-by-side alignment. In these alternative constructions the wires can be of different gages and their respective positioning will be determined by the particular termination being completed.

As will also be apparent to one skilled in the art the invention can readily be adapted to producing articles in a variety of sizes and configurations that are dependent only on the specific application or end use of the terminal.

Additional specific configurations and advantages of the invention will be apparent to those familiar with the art in view of the teachings of this specification and drawings.

DETAILED DESCRIPTION OF THE INVENTION

In the drawings accompanying and forming part of this specification:

Figure 1A:
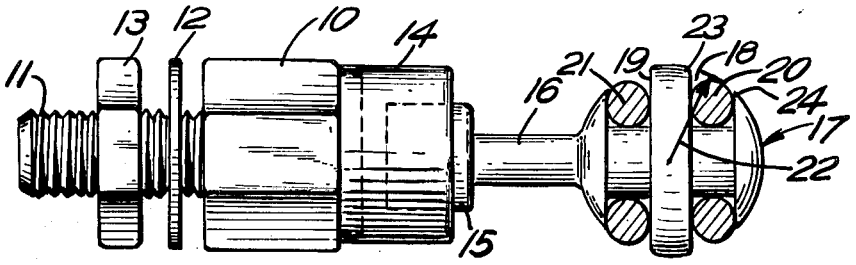
FIG. 1A is an elevational view showing one embodiment of the invention suitable for completing a two-wire interconnection.

Referring to the drawings in detail, wherein like reference characters designate corresponding parts throughout the several figures, and particularly to FIG. 1A, there is shown an insulated, stud-mounted terminal incorporating the improved spherical terminal post of my invention. Hexagonal shank 10 and threaded base 11, conventionally machined from metal stock, are affixed to insulating medium 14, which can be polytetrafluoroethlylene, diallyl phthalate, ceramic, or other suitable material having high dielectric properties. Lock washer 12 and hex nut 13 are used for mounting the terminals.

Affixed to the insulating medium 14 opposite the hexagonal shank is the wire termination unit consisting of base 15, shaft 16 and spherical post 17. Base 15 is affixed to the insulating medium 14 by adhesive, a threaded connection or by directly molding the insulation around the base. Typically, the wire termination unit will be machined from conductive stock such as brass and its dimensions will be dependent upon the size, gage and/or the number of wires to be connected, and to the spacial arrangements in the circuit where the terminal is to be used. For example, to facilitate wire wrapping and soldering, it may be desirable to increase the length of shaft 16 so that spherical post 17 stands above other circuit elements assembled on the chassis or mounting board. In the embodiment of FIG. 1A, post 17 is provided with circumferential slots 18 and 19 which are perpendicular to the longitudinal or major axis of the terminal. Elements 20 and 21, shown in cross-section, are electrical wires which are closely fitted in the slots 18 and 19, respectively. The radial depth of the slots is such that the outer or upper surface of the wrapped wire will not extend beyond the projection of the adjacent spherical surfaces. This is illustrated in FIG. 1A where the radius of curvature 22 of the sphere sweeping between shoulders 23 and 24 of slot 18 is tangential to, or slightly above, the outer surface of wire 20. As will be explained in more detail below, this arrangement permits the molten solder to fill the interstices between the slot walls and the wrapped wire and produces the desired smooth and substantially spherical surface. Also as shown in FIG. 1A, all sharp edges on the terminal stud are broken, for example to a minimum radius of 0.40 mm (0.015 in).

Figure 1B:
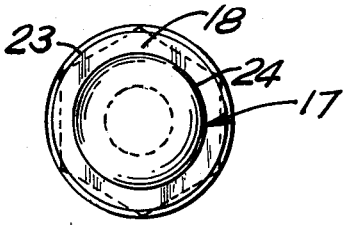
FIG. 1B is a top view of the invention of FIG. 1A.

FIG. 1B is a top view of the terminal assembly described above, where the dotted concentric line depicts the depth of the machined slots.

Figure 2:
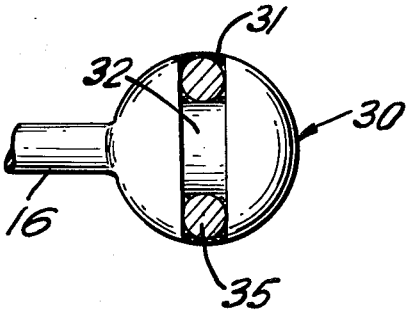
FIG. 2 is an elevational view of the spherical termlinal post only, illustrating a finished single wire termination employing the invention.

FIG. 2 is illustrative of another embodiment of the invention and, for simplicity, shows only the spherical post 30. In this embodiment, a single slot 31 has been machined into post 30, and wire 35 has been snugly wrapped around the remaining central support column 32. Molten solder has been applied and, as shown, has completely filled the interstices between the wire 35 and the base and side walls of slot 31 to form a smooth surface between the upper and lower shoulders of the slot.

Figure 3:
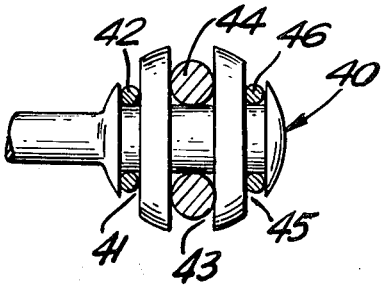
FIG. 3 is an elevational view of a further embodiment of the spherical terminal post of my invention.

FIG. 3 illustrates a further embodiment of the spherical terminal post adapted to complete a three wire connection, where each of the wires is a different gage. As is clearly shown in this view, the width of the slot is dependent only upon the gage, or diameter, of the wire, while the depth of the slot is determined by both the wire's gage and the relative position of the slot on the longitudinal axis of the terminal. Thus, for a given gage of wire, the shallowest slot which will permit the outer surface of the wire to remain below the projection of the adjacent spherical surfaces is located at the major diameter of the sphere.

In particular, three slots, 41, 43 and 45, have been machined into post 40, and three wires 42, 44 and 46 have been snugly wrapped around the support column, within the respective slots. As clearly shown in FIG. 3, the widths of slots 41, 43 and 45, are related to the depths of the respective slots relative to the projection of the adjacent spherical surfaces of post 40. That is, the depth and width of slot 43, adapted to receive a wire 44 of relatively large gage, will be relatively greater than the depths and widths of slots 41 and 45, which are adapted to receive wires 42 and 46 of relatively small gage.

Figure 4:
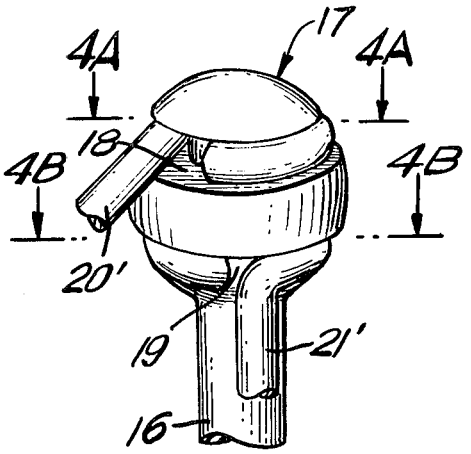
FIG. 4 is a perspective view of the spherical terminal post only illustrating the soldered assembly of an embodiment similar to that shown in FIG. 1.

FIG. 4 is a perspective view of a finished soldered two-wire interconnection similar to that shown in FIG. 1. The corresponding elements are similarly identified. As will be appreciated by one familiar with the art, the wires can be wrapped to provide a tangential intersection with the terminal as is wire 20', or in alignment with a plane through the longitudinal axis of the terminal, as is wire 21'.

Figure 4A:
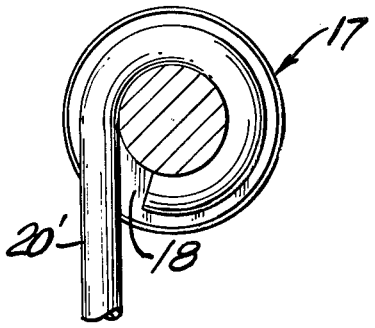
FIG. 4A is a top view, taken through section 4A—4A, of FIG. 4.

FIG. 4A is a top view, taken through section 4A—4A, of the two-wire interconnection of FIG. 4.

Figure 4B:
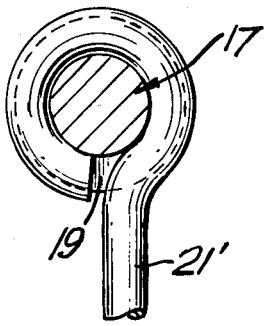
FIG. 4B is a top view, taken through section 4B—4B, of FIG. 4.

FIG. 4B is a top view, taken through section 4B—4B, of the two-wire interconnection of FIG. 4.

The above figures are illustrative of a family of spherical post terminals which can accommodate any desired wire size and which can be used for single wire terminations as well as multiple-wire interconnections. Thus, a single wire terminal has one slot and a three-wire terminal has three slots on the spherical post, and the diameter of the spherical post can be increased or decreased as required to accommodate the number of wires and the wire size.

Figure 5:
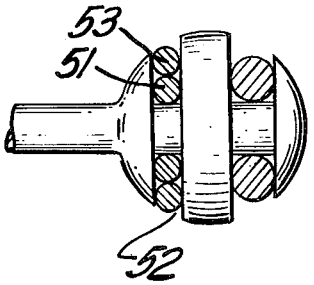
FIG. 5 is a cross-sectional elevational view showing one embodiment of the invention suitable for completing a three wire connection, two of the wires being wrapped concentrically in a single slot.
Figure 6:
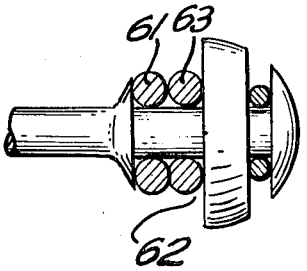
FIG. 6 is an elevational view showing one embodiment of the invention suitable for completing a three wire connection, two of the wires being wrapped parallel to one another in a single slot.

Multiple wire connections can be accomplished within a single slot; however, the diameter of the sphere will have to be increased significantly when compared to the configuration of the terminal accommodating a single wire per slot. The time required to rapidly complete the soldering step to produce a substantially spherical finished structure may be increased somewhat when the wires are placed in the side-by-side configuration.

Where the diameters of the wires are relatively small compared to the diameter of the spherical terminal, or where two small diameter wires are to be interconnected with a larger diameter wire, the small wires can be wrapped concentrically in a single slot. This latter arrangement is shown in FIG. 5, where two wires 51 and 53 are wrapped concentrically in slot 52.

Where two wires are to be connected in a single slot, and the depth of the slot does not allow the two wires to be wrapped concentrically, the wires can be wrapped in parallel planes in a single slot. This arrangement is shown in FIG. 6, where two wires 61 and 63 are wrapped preparatory to soldering in slot 62 in side-by-side configuration.

As will be apparent to those skilled in the art, other configurations are suggested by the above description and the invention is not intended to be limited to the specific embodiments, which are merely illustrative of the novel features of the invention, but is to be extended also to such modifications coming within the scope and spirit of the invention as set forth in the claims.

What is claimed is:

1. A method of producing a wrapped wire termination, comprising the steps of wrapping a wire termination of predetermined gage snuggly within a circumferential slot in a substantially spherical terminal such that said wire termination does not substantially extend above the projection of adjacent spherical surfaces of said spherical terminal, and soldering said wire termination wrapped within said slot to said spherical terminal such that solder substantially fills the interstices between said wire termination and said slot to thus form a substantially smooth surface over said spherical terminal.

2. A method of producing a wrapped wire termination, comprising the steps of wrapping first and second wire terminations of predetermined gage snuggly within respective first and second circumferential slots in a substantially spherical terminal such that said first and second wire terminations do not substantially extend above the projections of adjacent spherical surfaces of said spherical terminal, and soldering said first and second wire terminations wrapped within said respective first and second slots to said spherical terminal such that solder substantially fills the interstices between said first and second wire terminations and said respective first and second slots to thus form a substantially smooth surface over said spherical terminal.

3. A method of producing a wrapped wire termination, comprising the steps of wrapping first and second wire terminations of predetermined gage snuggly within a circumferential slot in a substantially spherical terminal such that said first and second wire terminations do not substantially extend above the projection of adjacent spherical surfaces of said spherical terminal, and soldering said first and second wire terminations wrapped within said slot to said spherical terminal such that solder substantially fills the interstices between said first and second wire terminations and said slot to thus form a substantially smooth surface over said spherical terminal.

4. A wrapped wire termination comprising:

a substantially spherical terminal having at least one circumferential slot therein, at least one wire termination of predetermined gage wrapped within said at least one slot such that said at least one wire termination does not substantially extend above the projection of adjacent spherical surfaces of said spherical terminal, and solder disposed within the interstices between said at least one wire termination and said at least one slot, such that a substantially smooth surface is formed over said spherical terminal.

5. The wrapped wire termination of claim 4 wherein said spherical terminal has a plurality of circumferential slots therein and each of a plurality of wire terminations is wrapped within an associated circumferential slot.

6. The wrapped wire termination of claim 5 wherein each of said plurality of circumferential slots has a depth related to the gage of its associated wire termination, the gages of at least two of said plurality of wire terminations being different from one another.

7. The wrapped wire termination of claim 4 wherein a plurality of wire terminations is wrapped within said slot.

* * * * *